US011806681B2

(12) United States Patent
Mankosa et al.

(10) Patent No.: US 11,806,681 B2
(45) Date of Patent: Nov. 7, 2023

(54) MULTILOBULAR SUPERSONIC GAS NOZZLES FOR LIQUID SPARGING

(71) Applicant: Eriez Manufacturing Co., Erie, PA (US)

(72) Inventors: Michael J. Mankosa, Erie, PA (US); John Craig Lewis, Rome, OH (US); Gerald H. Luttrell, New Smyrna Beach, FL (US); Derek J. Connors, Erie, PA (US)

(73) Assignee: Eriez Manufacturing Co., Erie, PA (US)

( * ) Notice: Subject to any disclaimer, the term of this patent is extended or adjusted under 35 U.S.C. 154(b) by 305 days.

(21) Appl. No.: 16/763,195

(22) PCT Filed: Nov. 15, 2018

(86) PCT No.: PCT/US2018/061310

§ 371 (c)(1),
(2) Date: May 11, 2020

(87) PCT Pub. No.: WO2019/099691

PCT Pub. Date: May 23, 2019

(65) Prior Publication Data

US 2021/0069661 A1 Mar. 11, 2021

Related U.S. Application Data

(60) Provisional application No. 62/586,579, filed on Nov. 15, 2017.

(51) Int. Cl.

| | |
|---|---|
| ***B01F 25/20*** | (2022.01) |
| ***B05B 1/00*** | (2006.01) |
| ***B05B 1/14*** | (2006.01) |
| ***B01F 23/231*** | (2022.01) |
| *B05B 1/30* | (2006.01) |

(52) U.S. Cl.

CPC ..... *B01F 25/28* (2022.01); *B01F 23/23121* (2022.01); *B05B 1/005* (2013.01); *B05B 1/14* (2013.01); *B01F 23/231265* (2022.01); *B05B 1/302* (2013.01)

(58) Field of Classification Search

CPC ..... B01F 23/231265; B01F 25/28; B01F 23/23121; B05B 1/005; B05B 1/14; B05B 1/302

USPC ..... 239/589, 600, DIG. 3, DIG. 21, 433; 261/21, 31, 76, 78.2, 115, DIG. 65

See application file for complete search history.

(56) References Cited

U.S. PATENT DOCUMENTS 3,277,971 A * 10/1966 Dawson ..... E21B 21/16 175/71
8,104,745 B1 * 1/2012 Fisenko ..... F04F 5/465 261/76

(Continued)

*Primary Examiner* — Steven J Ganey
(74) *Attorney, Agent, or Firm* — Jonathan M. D'Silva; MMI Intellectual Property

(57) ABSTRACT

What is presented is a system and method for bubble creation in a fluid injection nozzle for the injection of a gas into a liquid to divide the gas into the smallest possible bubble size with the largest cumulative surface area by maximizing the percentage of gas at the highest possible kinetic energy that is in contact with the liquid. The fluid injection nozzle comprises a convergent inlet for receiving a fluid and a divergent outlet for exhausting the fluid. The divergent outlet has multiple exhaust ports.

23 Claims, 4 Drawing Sheets

(56) References Cited

U.S. PATENT DOCUMENTS

| | | | | |
|---|---|---|---|---|
| 2001/0017325 | A1* | 8/2001 | Harata | F02M 51/0678 239/596 |
| 2002/0112889 | A1* | 8/2002 | Larsen | E21B 10/18 239/600 |
| 2013/0208557 | A1* | 8/2013 | Fabiyi | C02F 3/16 261/31 |
| 2015/0211462 | A1* | 7/2015 | Schnobrich | F02M 61/1853 239/589 |

* cited by examiner

MULTILOBULAR SUPERSONIC GAS NOZZLES FOR LIQUID SPARGING

BACKGROUND

Sparging is the process of entraining large volumes of gas into bulk liquid, often with significant and energetic mixing of the resultant dispersion. Sparging processes are commonly utilized in many physical and chemical industrial applications to induce or accelerate reactions, phase changes, and separations. Such processes include: aeration, agitation, bioremediation, bulking, carbonation, chlorine bleaching, column flotation, dewatering, fermentation, gas/liquid reactions, hydrogenation, oil flotation, oxygen bleaching, oxygen stripping, oxygenation, ozonation, pH control, steam injection, and volatiles stripping, among others. These processes are utilized in the mining, food processing, medical, pharmaceutical, environmental, sanitation, paper, textile, automotive, and energy production industries, among others.

In examples of prior art, the sparging process has been accomplished by means of cloth or screen filters, fluidized beds, porous sintered metal and similar stone-like materials, perforated pipes, rotating mixers and impellers with or without internal gas passages and perforations, cavitation devices, and direct high velocity gas injectors. Limitations and deficiencies evident in these examples of prior art include a predisposition to clogging that necessitates expensive maintenance, low energy efficiency with attendant energy costs, low process efficiency due to larger bubble formation, low gas concentration, mechanical complexity, maintainability, and reliability issues. What is presented relates to fluid injection nozzles and apparatus which improve the performance and efficiency of sparging applications by entraining increased volumes of gas into the liquid by creating larger numbers of smaller bubbles than heretofore achievable with direct high-volume gas sparger devices.

SUMMARY

What is presented is a system and method for bubble creation in a fluid injection nozzle for the injection of a gas into a liquid to divide the gas into the smallest possible bubble size with the largest cumulative surface area by maximizing the percentage of gas at the highest possible kinetic energy that is in contact with the liquid. The fluid injection nozzle comprises a convergent inlet for receiving a fluid and a divergent outlet for exhausting the fluid. The divergent outlet has multiple exhaust ports.

In various embodiment, each exhaust port may be oblique to the fluid flow direction through the exhaust port. Each exhaust port may diverge from the central axis of the fluid injection nozzle. The axis of each exhaust port may describe an arc. Each exhaust port may terminate in an outer surface of the fluid injection nozzle that is not perpendicular to the central axis of the fluid injection nozzle. Each exhaust port may terminate in an outer surface of the fluid injection nozzle that is parallel to the central axis of the fluid injection nozzle.

The fluid injection nozzle may be manufactured of a wear resistant material comprising plastic, metal, ceramic, or urethane overmolded over steel.

The fluid may be a gas or an aerosol. The divergent outlet may discharge into a liquid, a slurry, or a gas.

In some embodiments, a throttling device maybe be incorporated to variably blocks or restricts the fluid from entering the convergent inlet. The divergent outlet may comprise two exhaust ports, three exhaust ports, four exhaust ports, five exhaust ports, or six exhaust ports. The orientation of the exhaust ports relative to the gravitational field is between sixty degrees and one hundred and twenty degrees of vertical.

The angle by which the exhaust ports diverge from the central axis increases in the downstream direction from a value of zero at its narrowest up to a maximum of between 25 degrees and 45 degrees. In various embodiments, the exhaust ports end on an outer surface of the fluid injection nozzle that is parallel to the central axis.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
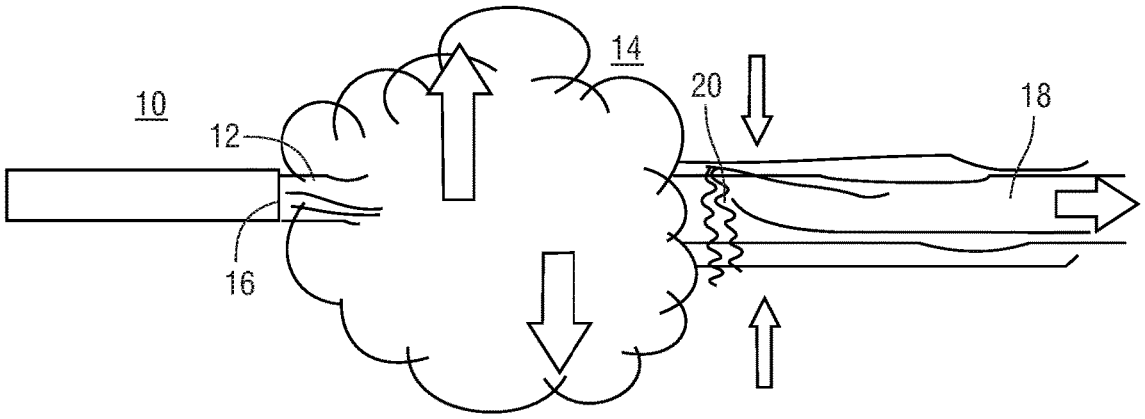
Prior Art Fig.1
FIG. 1 illustrates the operation of a prior art fluid injection nozzle that has a single exhaust port.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

As shown in FIG. 1, prior art fluid injection nozzles 10 generally inject gas 12 directly into bulk liquids 14 through a single exhaust port 16 that runs through the central axis of the fluid injection nozzle 10. This creates a gas jet flow 18 in line with the central axis of the fluid injection nozzle 10 in the same direction that the fluid injection nozzle 10 is oriented in the bulk liquid 14. The high-pressure gas 12 exits the exhaust port 16 of the fluid injection nozzle 10 as a gas jet flow 18 that enters the bulk liquid 14.

The gas jet flow 18 is at a higher pressure that the bulk liquid 14 that is at a much lower ambient pressure. This causes the gas jet flow 18 to rapidly expand in all directions explosively forming singularly large bubbles. The velocity of the expansion is perpendicular to the gas/liquid boundary. A transonic shockwave 20 develops that causes abrupt pressure increases and stagnation of the gas jet flow 18. This causes part of the gas jet flow 18 to be reflected back towards the exhaust port 16.

The high velocity of the gas jet flow 18 also causes a reduced pressure perpendicular to the gas jet flow. This further causes the bulk liquid 14 to accelerate towards the gas jet flow 18 downstream of the shockwave 20. The momentum of the liquid moving towards the gas jet flow 18 overshoots and causes the gas jet flow 18 to be pinched off and further causes the movement of the gas jet flow 18 downstream of the shockwave 20 to reverse and oscillate.

In general, small bubbles are only formed where the gas velocity vector is parallel to the gas/liquid boundary. When gas expands perpendicular to the gas/liquid boundary, the gas velocity vector is also perpendicular which causes the formation of large bubbles. The fluid injection nozzles and apparatus presented herein improve the efficiency of supersonic gas injection into bulk liquids by eliminating the unstable transonic shock wave phenomenon, known in related research as "back-attack", which in the prior art wastes major fractions of the injected gas as periodic very large bubble formations.

Figure 2:
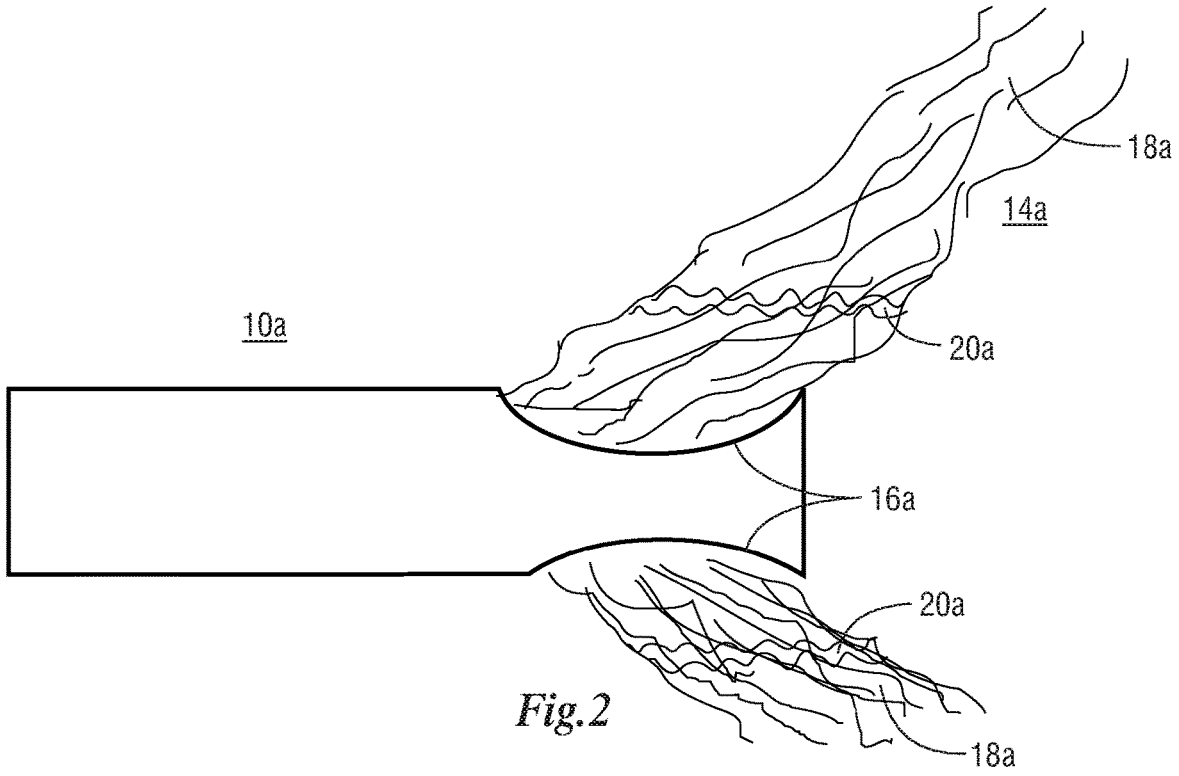
FIG. 2 illustrates the operation of an embodiment of fluid injection nozzle that has multiple exhaust ports.

One aspect of the fluid injection nozzle and apparatuses is shown in FIG. 2. The fluid injection nozzles 10*a* disclosed herein have multiple exhaust ports 16*a*. The exhaust ports 16*a* shown are oblique to the fluid flow direction through the exhaust port 16*a* and diverge from the central axis of the fluid injection nozzle 10*a*. The axis of each exhaust port 16*a* also describes an arc rather than a straight line in prior art devices. The oblique exhaust ports 16*a* form stable oblique shock waves 20*a* that do not reflect the gas jet flow 18*a* back into the exhaust port 16*a*. The oblique exhaust ports 16*a* induce formation of smaller bubbles while preventing explosive expansions from forming large bubbles. The exhaust ports 16*a* also terminate on an outer surface of the fluid injection nozzle 10*a* that is not perpendicular to the central axis of the fluid injection nozzle 10*a* and in the figure, the exhaust ports 16*a* terminate on an outer surface of the fluid injection nozzle 10*a* that is parallel to the central axis of the fluid injection nozzle 10*a*.

The smallest bubbles in these systems are formed in the high-energy turbulent boundary shear area of the high velocity gas jet flow 18*a* moving through the bulk liquid 14*a*. The energy transfer in this turbulent boundary area is responsible for the creation of the smallest bubbles. In prior art embodiments such as those shown in FIG. 1, single exhaust ports 16 create an inefficient single gas jet flow 18 stream. Because contact between the high energy, high velocity gas jet stream and bulk liquid primarily occurs at the boundaries, energy is transferred from the gas jet flow 18 into bubble formation generally only at the boundaries. The decelerating gas jet flow 18 does not allow the gas in the center of the gas jet flow 18 to come in contact with the bulk liquid 14 until it has been decelerated to a relatively low velocity and low energy which is incapable of generating small bubbles. As a result, this unreacted gas penetrates deeply into the bulk liquid 14, forming a long gas jet flow 18, until its kinetic energy is completely dissipated, and the gas gradually divides into large bubbles.

As shown in FIG. 2, splitting up the gas jet flow 18*a* into multiple exhaust ports 16*a* creates multiple gas jet flow 18*a* streams which increases the effective high energy boundary shear area. Much more high kinetic energy gas meets the bulk liquid 14*a* before its kinetic energy is dissipated. For example, with embodiments that split the gas jet flow into three streams, one third of the total gas volume is divided into each stream while increasing the effective high-energy boundary shear area by 73% over single stream prior art systems. Because of the larger percentage of gas being presented at the at the high-energy boundary area, more of the gas is dispersed as small bubbles much earlier before the kinetic energy of the gas jet flow is dissipated. This results in much less gas available to form large bubbles.

The fluid injection nozzles and apparatus presented reduce average bubble size and increase the proportion of injected gas volume contained in smaller bubbles in sparged gas/liquid dispersions by increasing the effective area of high velocity shearing boundary layer between the gas and liquid in proportion to the volume of gas injected.

Figure 3:
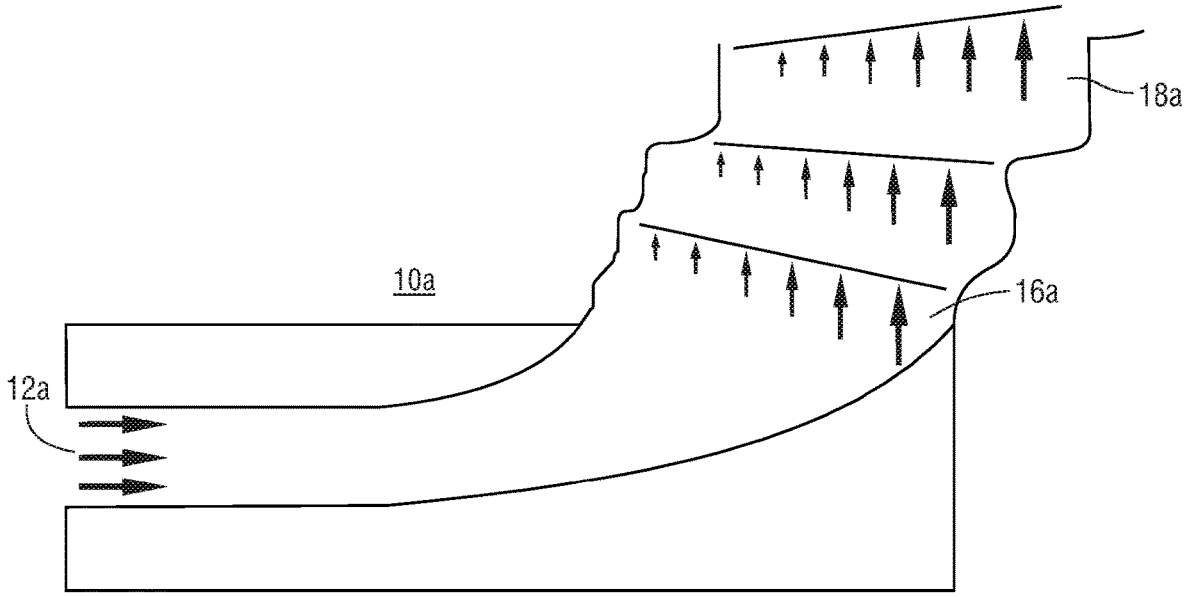
FIG. 3 illustrates fluid flow through an oblique exhaust port in one embodiment of fluid injection nozzle.

That the exhaust ports 16*a* are oblique to the fluid flow direction through the exhaust ports 16*a*, that they diverge from the central axis of the fluid injection nozzle, and that they have an axis that describes an arc, presents another feature that is illustrated in FIG. 3. As the gas jet flow 18*a* exits the fluid injection nozzle 16*a*, the gas 12*a* has differential velocity depending on its path out of the fluid injection nozzle 10*a* through the exhaust port 16*a*. A shorter flow path results in a lower gas velocity indicated by the shorter arrows in the figure. A longer flow path results in a higher gas velocity as indicated by the longer arrows in the figure. Lower velocity gas 12*a* comes into contact with the bulk liquid 14*a* first and thus is further decelerated into bubbles. Higher velocity gas 12*a* comes into contact with the bulk liquid 14*a* later and this maintains higher velocity longer before it is decelerated enough to form bubbles.

The differential velocity of the inner and outer paths causes the flow direction to rotate away from the central axis of fluid injection nozzle 10*a*, exposing more of the high energy, high velocity turbulent boundary shear layer of gas 12*a* to the bulk liquid 14*a*. This high energy turbulence causes smaller bubbles to form while leaving less gas isolated from liquid contact.

Due to much greater and earlier contact between high energy, high velocity gas 12*a* and bulk liquid 14*a*, the kinetic energy of the gas 12*a* is dissipated into a formation of small bubbles very quickly and close to the fluid injection nozzle 10*a* while the energy in the turbulent boundary layer is still high. The relatively little unincorporated gas which is left does not have enough kinetic energy remaining to penetrate deeply into the bulk liquid 14*a*. So, the gas jet flow 18*a* is very short in the embodiments presented herein.

Figure 4:
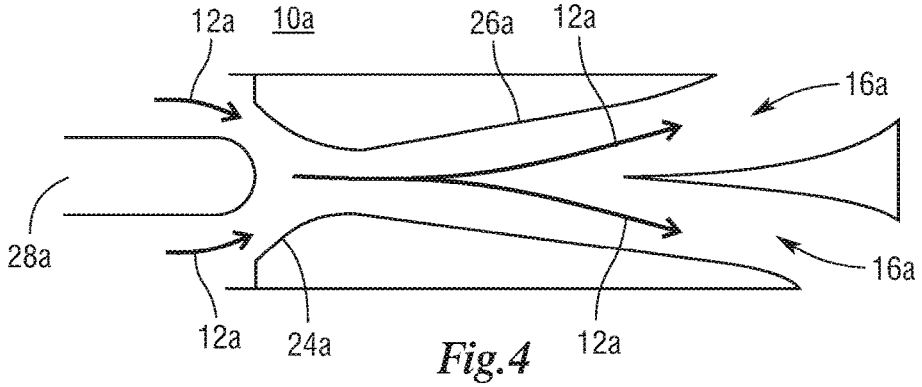
FIG. 4 is a cross section schematic showing an embodiment of fluid injection nozzle.

Another feature of the fluid injection nozzles 10*a* presented herein is shown in FIG. 4. High pressure fluid 12*a* injected through the fluid injection nozzle 10*a* encounters a convergent inlet 24*a* for receiving the fluid 12*a* which expends into a divergent outlet 26*a* for exhausting the fluid

12*a*. High pressure fluid 12*a* that encounters the convergent inlet 24*a* accelerates smoothly to reach the speed of sound at the narrowest point of convergence after which the fluid 12*a* transitions into the divergent outlets 26*a* that cause the fluid 12*a* to expand and accelerate beyond the local speed of sound. Divergence is caused by the combination of smoothly increasing cross sectional area and the multiple divergent exhaust ports 16*a*.

The operation of fluid injection nozzle 10*a* is best understood by referring to FIG. 4. A fluid 12*a*, typically compressed gas, enters the nozzle at the convergent inlet. This gas 12*a* flow may or may not be mixed with a lesser volume of liquid. If a liquid is mixed with the gas flowing into the convergent inlet, some means (not shown) may be provided to control and optimize the mix ratio. In such embodiments, the fluid injection nozzle 10*a* is injecting an aerosol through to the bulk liquid 14*a*.

The fluid 12*a* flow may be throttled or enabled/disabled by a throttling device 28*a* that variably blocks or restricts the fluid from entering the convergent inlet 24*a*. The throttling device 28*a* could comprise a control rod fitted with an elastomeric valving tip or be some other device known in the prior art. The fluid 12*a* velocity reaches the local speed of sound as it passes through the most restricted point convergent inlet 24*a*.

After passing through the convergent inlet 24*a*, the fluid 12*a* flow expands as the cross-sectional area of the divergent outlet 26*a* increases in the downstream direction. This causes the fluid 12*a* pressure to diminish and causes the fluid 12*a* velocity to further increase in the supersonic domain. The wall contours of the divergent outlet 26*a* are designed to minimize turbulent, frictional, and shock wave losses so that energy conversion from potential energy of fluid 12*a* pressure can most efficiently be converted to kinetic energy of fluid 12*a* velocity.

Figure 5:
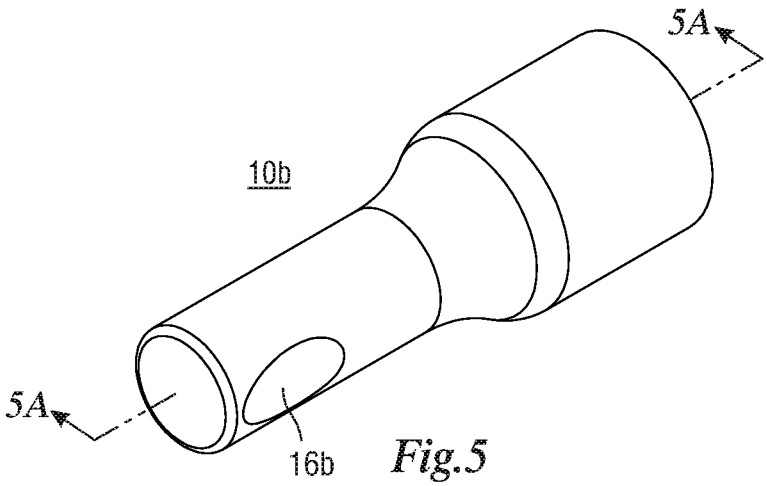
FIG. 5 is a perspective view of an embodiment of fluid injection nozzle that comprises two exhaust ports.
Figure 5B:
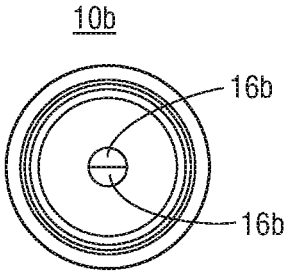
FIG. 5B is a rear view of the fluid injection nozzle of FIG. 5.
Figure 5A:
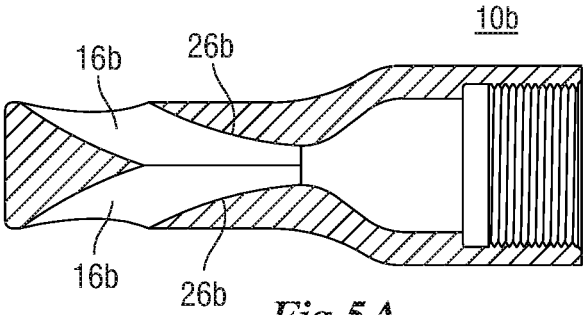
FIG. 5A is a cross sectional view of the fluid injection nozzle of FIG. 5.
Figure 6:
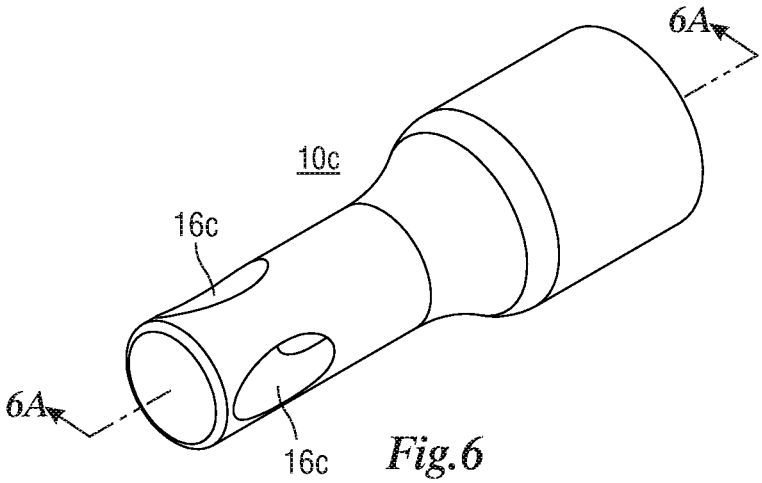
FIG. 6 is a perspective view of an embodiment of fluid injection nozzle that comprises three exhaust ports.
Figure 6B:
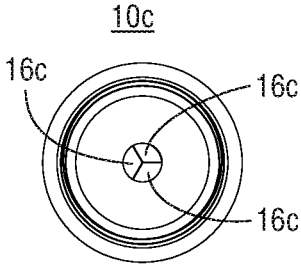
FIG. 6B is a rear view of the fluid injection nozzle of FIG. 6.
Figure 6A:
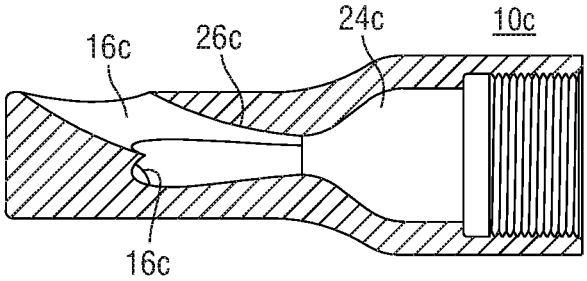
FIG. 6A is a cross sectional view of the fluid injection nozzle of FIG. 6.
Figure 7:
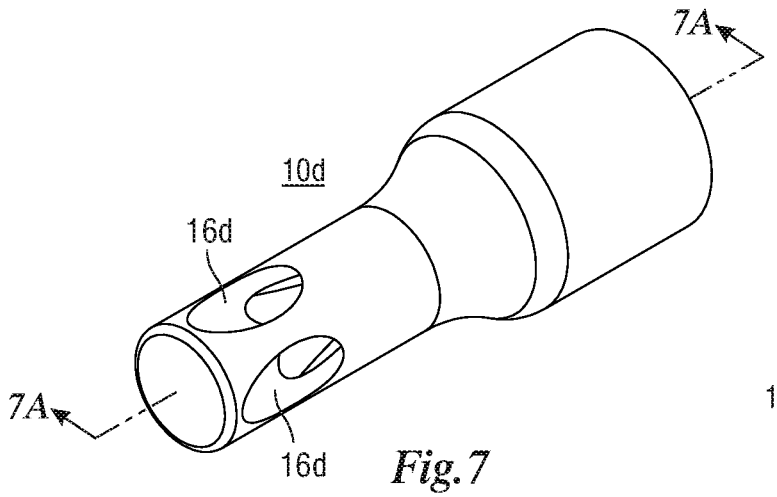
FIG. 7 is a perspective view of an embodiment of fluid injection nozzle that comprises four exhaust ports.
Figure 7B:
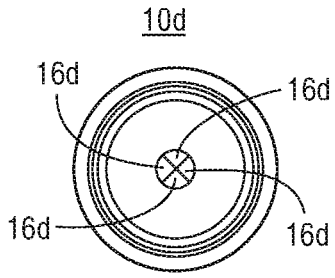
FIG. 7B is a rear view of the fluid injection nozzle of FIG. 7.
Figure 7A:
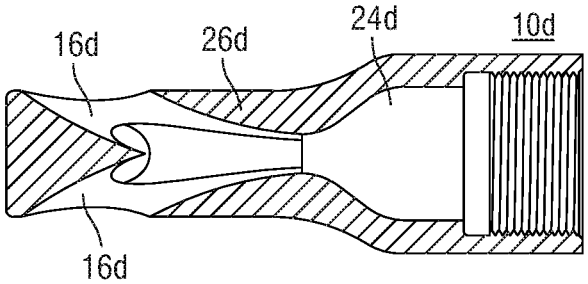
FIG. 7A is a cross sectional view of the fluid injection nozzle of FIG. 7.
Figure 8:
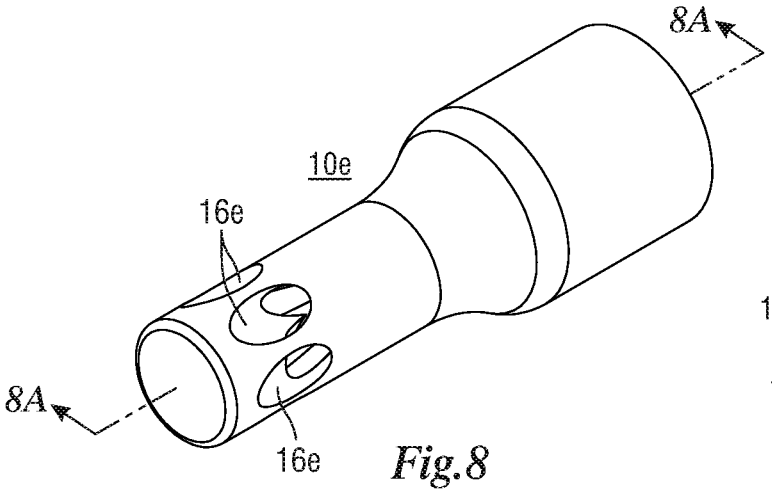
FIG. 8 is a perspective view of an embodiment of fluid injection nozzle that comprises six exhaust ports.
Figure 8B:
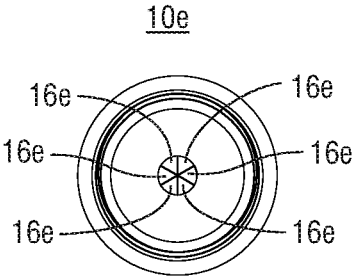
FIG. 8B is a rear view of the fluid injection nozzle of FIG. 8.
Figure 8A:
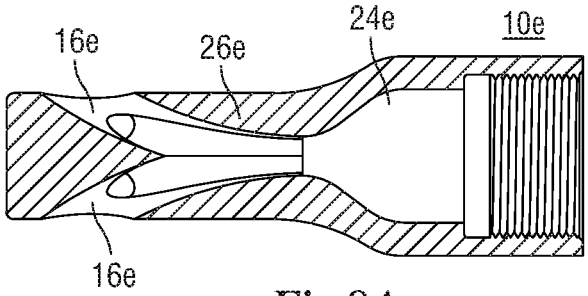
FIG. 8A is a cross sectional view of the fluid injection nozzle of FIG. 8A.

The divergent outlet 26*a* is comprised of multiple exhaust ports 16*a* through which the fluid 12*a* progresses. These exhaust ports 16*a* may or may not be symmetrical and/or equal in size and shape. The total volume expansion rate of all the exhaust ports 16*a* summed together is designed to maximize energy conversion efficiency and maximize kinetic energy in the resultant gas or aerosol jet flow. Various embodiments of fluid injection nozzles may have divergent outlets that comprise two exhaust ports (as shown in FIGS. 5, 5A, and 5B), three exhaust ports (as shown in FIGS. 6, 6A, and 6B—this is the preferred embodiment of the disclosed fluid injection nozzles), four exhaust ports (as shown in FIGS. 7, 7A, and 7B), five exhaust ports, or six exhaust ports (as shown in FIGS. 8, 8A, and 8B). The number of exhaust ports can vary by the particular application.

The orientation of the exhaust ports relative to the gravitational field may also vary with different embodiments with the optimum orientation between sixty degrees and one hundred and twenty degrees of vertical. In various embodiments, the angle by which the exhaust ports diverge from the central axis increases in the downstream direction from a value of zero at its narrowest up to a maximum of between 25 degrees and 45 degrees. The exhaust ports terminate on an outer surface of the fluid injection nozzle that is not perpendicular to the central axis of the fluid injection nozzle. Preferably, the exhaust ports terminate on an outer surface of the fluid injection nozzle that is parallel to the central axis of the fluid injection nozzle. Each divergent outlet may discharge into a liquid, a slurry, or a gas.

The fluid injection nozzle is manufactured of any wear resistant material such as plastic, metal, ceramic, or urethane overmolded over steel. The fluid injection nozzle may be manufactured using 3-D printers or otherwise machined or formed.

In each of these embodiments in FIGS. 5 to 8B, the fluid injection nozzle comprises the divergent outlet with multiple exhaust ports. The exhaust ports shown are oblique to the fluid flow direction through the exhaust port. They also diverge from the central axis of the fluid injection nozzle. The exhaust ports also end on an outer surface of the fluid injection nozzle that is not perpendicular to the central axis of the fluid injection nozzle and in each case shown are parallel to the central axis of the fluid injection nozzle. These exhaust ports have an axis that describes an arc curved outward from the central axis of the fluid injection nozzle to separate the gas flow jets in the bulk liquid to maximize the high velocity/high energy boundary layer area where small bubbles are formed. The divergence angle and rate of curvature balance energy conversion efficiency with increased boundary layer area and to improve performance.

The curvature of gas paths in the exhaust ports also causes fluid to traverse a longer path closer to the fluid injection nozzle central axis and a shorter path farther from the fluid injection nozzle central axis. As a result, the fluid flow develops vector curl which becomes beneficial in mixing the bulk liquid with the fluid flow after it is discharged from the fluid injection nozzle.

The exhaust ports are arranged with the plane of opening oblique to the gas flow. As a result, high velocity gas or aerosol particles farther from the nozzle central axis contact the bulk liquid earlier than gas or aerosol particles that are closer to the central axis but in the same plane perpendicular to the local velocity vector of the gas or aerosol. This causes the velocity of the gas or aerosol nearer the central axis of the nozzle to be greater than the gas or aerosol velocity farther from the central axis of the nozzle. This develops further vector curl in the flow, which causes the gas or aerosol jets in the bulk liquid to further diverge from the nozzle central axis, exposing a greater area of high turbulence boundary layer between the high velocity gas or aerosol flow and the bulk liquid.

In addition, the oblique angle of the exhaust port causes a reduction in gas or aerosol pressure at the point where the gas or aerosol flow first contacts the bulk liquid. This draws bulk liquid into the high velocity gas or aerosol flow, further augmenting the high energy microscopic turbulent mixing of gas and liquid, which augments the formation of smaller bubbles.

The features of the fluid injection nozzle are optimized to eliminate the transonic shock wave formation or "back-attack" explosive expansion phenomena, which would otherwise reduce the system efficiency.

What is presented herein is a method for bubble creation in a fluid injection nozzle. Specifically, the method serves for the injection of a gas into a liquid to divide the gas into the smallest possible bubble size with the largest cumulative surface area by maximizing the percentage of gas at the highest possible kinetic energy that is in contact with the liquid. This is achieved by introducing the gas into the fluid injection nozzle through a convergent inlet and exhausting the fluid from the fluid injection nozzle through a divergent outlet that has multiple exhaust ports. The number of exhaust ports could be two exhaust ports, three exhaust ports, four exhaust ports, five exhaust ports, or six exhaust ports. A throttling device may also be used to variably block or restrict the gas from entering the convergent inlet The method could be varied by exhausting the fluid from each exhaust port oblique to the fluid flow direction through the exhaust port. The fluid could also be exhausted from each exhaust port divergent from the central axis of the fluid injection nozzle. The termination point of each exhaust port could be varied from the prior art to be an outer surface of the fluid injection nozzle that is not perpendicular to the central axis of the fluid injection nozzle. In fact, the termination point of each exhaust port could be an outer surface of the fluid injection nozzle that is parallel to the central axis of the fluid injection nozzle.

Various methods of exhausting the fluid from the fluid injection nozzle may also be at an orientation relative to the gravitational field between sixty degrees and one hundred and twenty degrees of vertical. The fluid may be exhausted from the fluid injection nozzle at an angle divergent from the central axis that increases in the downstream direction from a value of zero at its narrowest up to a maximum of between 25 degrees and 45 degrees.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. A fluid injection nozzle comprising
a convergent inlet for receiving a fluid;
a divergent outlet for exhausting the fluid;
said divergent outlet having multiple divergent exhaust ports; and
each said divergent exhaust port terminates in an outer surface of said fluid injection nozzle that is not perpendicular to a central axis of said fluid injection nozzle.

2. The fluid injection nozzle of claim 1 in which each said divergent exhaust port is oblique to a fluid flow direction through said divergent exhaust port.

3. The fluid injection nozzle of claim 1 in which each said divergent exhaust port diverges from said central axis of said fluid injection nozzle.

4. The fluid injection nozzle of claim 1 in which each said divergent exhaust port comprise an axis that describes an arc.

5. The fluid injection nozzle of claim 1 in which each said divergent exhaust port terminates in an outer surface of said fluid injection nozzle that is parallel to said central axis of said fluid injection nozzle.

6. The fluid injection nozzle of claim 1 in which a throttling device variably blocks or restricts said fluid from entering said convergent inlet.

7. The fluid injection nozzle of claim 1 in which said divergent outlet comprises two said divergent exhaust ports, three said divergent exhaust ports, four said divergent exhaust ports, five divergent said exhaust ports, or six said divergent exhaust ports.

8. The fluid injection nozzle of claim 1 in which the orientation of said divergent exhaust ports relative to a gravitational field in which the injection nozzle operates is between sixty degrees and one hundred and twenty degrees of vertical.

9. The fluid injection nozzle of claim 1 further comprising said exhaust ports diverge from said central axis at an increasing angle in the downstream direction.

10. The fluid injection nozzle of claim 1 in which the angle by which said divergent exhaust ports diverge from said central axis increases in the downstream direction from a value of zero at its narrowest up to a maximum of between 25 degrees and 45 degrees.

11. The fluid injection nozzle of claim 1 in which said fluid is a gas or an aerosol.

12. The fluid injection nozzle of claim 1 in which said divergent outlet discharges into a liquid, a slurry, or a gas.

13. The fluid injection nozzle of claim 1 which is manufactured of a wear resistant material comprising plastic, metal, ceramic, or urethane overmolded over steel.

14. A method for bubble creation in a liquid for the injection of a gas into the liquid to divide the gas into the smallest possible bubble size with the largest cumulative surface area by maximizing the percentage of gas at the highest possible kinetic energy that is in contact with the liquid comprising:
introducing the gas into a fluid injection nozzle through a convergent inlet;
exhausting the gas from the fluid injection nozzle through a divergent outlet that has multiple exhaust ports into the liquid to create bubbles in the liquid.

15. The method of claim 14 further comprising exhausting the gas from each exhaust port oblique to the gas flow direction through the exhaust port.

16. The method of claim 14 further comprising exhausting the gas from each exhaust port divergent from the central axis of the fluid injection nozzle.

17. The method of claim 14 further comprising exhausting the gas from each exhaust port in an outer surface of the fluid injection nozzle that is not perpendicular to the central axis of the fluid injection nozzle.

18. The method of claim 14 further comprising exhausting the gas from each exhaust port in an outer surface of the fluid injection nozzle that is parallel to the central axis of the fluid injection nozzle.

19. The method of claim 14 further comprising variably blocking or restricting the gas from entering the convergent inlet with a throttling device.

20. The method of claim 14 further comprising exhausting the gas through divergent outlets that comprises two exhaust ports, three exhaust ports, four exhaust ports, five exhaust ports, or six exhaust ports.

21. The method of claim 14 further comprising exhausting the gas from the fluid injection nozzle at an orientation relative to a gravitational field in which the injection nozzle operates between sixty degrees and one hundred and twenty degrees of vertical.

22. The method of claim 14 further comprising exhausting the gas from the fluid injection nozzle at an angle divergent from the central axis that increases in the downstream direction.

23. The method of claim 14 further comprising exhausting the gas from the fluid injection nozzle at an angle divergent from the central axis that increases in the downstream direction from a value of zero at its narrowest up to a maximum of between 25 degrees and 45 degrees.

* * * * *